US006644471B1

(12) United States Patent
Anderson

(10) Patent No.: US 6,644,471 B1
(45) Date of Patent: Nov. 11, 2003

(54) DISPENSING CAPSULE FOR A LIQUID CONTAINER

(76) Inventor: Michael R. Anderson, 1355 W. Palmetto Park Rd., No. 129, Boca Raton, FL (US) 33486

( * ) Notice: Subject to any disclaimer, the term of this patent is extended or adjusted under 35 U.S.C. 154(b) by 0 days.

(21) Appl. No.: 10/155,461

(22) Filed: May 24, 2002

(51) Int. Cl.[7] ..... B65D 25/08
(52) U.S. Cl. ..... 206/222; 206/219
(58) Field of Search ..... 206/219–222, 206/568; 215/DIG. 8; 222/80, 83, 129

(56) References Cited

U.S. PATENT DOCUMENTS 3,156,369 A * 11/1964 Bowes et al. ..... 206/222
4,247,001 A * 1/1981 Wiegner ..... 206/222
4,638,927 A 1/1987 Morane
4,858,760 A 8/1989 DiSturco
4,903,865 A * 2/1990 Janowitz ..... 206/222
5,246,142 A 9/1993 DiPalma et al.
5,352,196 A * 10/1994 Haber et al. ..... 215/DIG. 8
5,370,222 A 12/1994 Steigerwald et al.
5,692,644 A 12/1997 Gueret
5,711,420 A 1/1998 Spring
5,833,089 A 11/1998 Manni et al.
5,863,126 A 1/1999 Guild
5,980,959 A * 11/1999 Frutin ..... 206/222
6,148,996 A * 11/2000 Morini ..... 206/222

* cited by examiner

*Primary Examiner*—Luan K. Bui
(74) *Attorney, Agent, or Firm*—Malin, Haley & DiMaggio, P.A.

(57) ABSTRACT

A capsule that is inserted into the neck of a bottle, or within a pull-up liquid dispenser cap, said capsule being a container or receptacle for sealably containing a liquid and/or dry material and a dispenser for releasing the material when desired into the bottle through the orifice previously occupied by the first and second plugs frangibly sealed in a first position and unsealed mechanically by the consumer depressing an elongated shaft releasing the liquid and/or dry materials into the container body in second position. The present invention allows the use of materials that would discolor, degrade or interact with other substances when added to the contents of the bottle, to remain stable and/or inactive until the time of use.

8 Claims, 13 Drawing Sheets

DISPENSING CAPSULE FOR A LIQUID CONTAINER

BACKGROUND OF THE INVENTION

1. Field of the Invention

This invention relates to a liquid and/or dry ingredient dispensing capsule that is inserted into the neck or throat of a bottle or into the cap. The capsule stores liquid and/or dry substances which can be rapidly dispensed into the bottle by manual activation when desired and thereafter readily consumed by the user. The capsule may be pre-mounted in the bottle at the factory after the bottle itself is partially filled with a liquid or used with an existing bottle. A conventional bottle cap is used to seal the bottle contents, including the capsule.

2. Description of the Prior Art

Many foods, drugs, cosmetics, adhesives, polishes, cleansers, dyes and other substances are frequently supplied in liquid, powder or crystal form and do not retain their stability, strength and effectiveness for long after they have been mixed in solution or suspension. This incompatibility after mixing therefore mandates that the product be utilized relatively soon after mixture to prevent deterioration, discoloration, interactions and the like. It is also important that admixtures of various ingredients be done under conditions wherein a measured amount of one ingredient is added to a measured amount of the other chemical to insure that proper results are obtained.

Another concern involves merchandising of certain products, where it is frequently desirable to supply two companion products to the consumer in a single package. Thus, many products are, by their very nature, required to be used by the consumer shortly after their manufacture as they lose certain desirable characteristics with a short period of time, yet the product can be stored for extended periods of time if one ingredient is maintained separate from the other. In such case, the two ingredients may be mixed together to form the desired product shortly before use. In marketing such goods, it obviously is desirable that both ingredients be sold as part of the same package. From an aesthetic as well as a handling standpoint, it is desirable that but a single package be utilized for maintaining such compounds separated.

The use of conventional liquid containers such as plastic bottles for carrying water, juices, power drinks and other desirable liquids for human consumption is quite well known. There are, however, several non-active and active substances such as activated oxygen, vitamins, minerals, herbs, nutrients and flavors that would be desirable to be added to liquids such as water, juices or other beverages to give the consumer added benefits, particularly those useful for the health of the consumer. Many of the substances, however, that provide additional benefits when mixed into another liquid have short shelf lives, discolor, interact or degrade quickly when combined with liquids or other substances. Therefore, many beverages are currently sold without the added beneficial ingredients.

In a practical way of providing such desired results, containers have been provided having two compartments in which two ingredients may be stored separately until it is desired to mix them, at which time it is possible to establish communication between the compartments so that the separated ingredients may move from one compartment to the other.

It is known in the art to provide dispensers containing a concentrate of soluble materials to a fixed quantity of solute, usually water, for dispensing. Thus, the prior art teaches containers for beverages wherein the interior of the container is divided into a compartment having a basic ingredient and a compartment which can be ruptured so as to mix, within the container the basic ingredient and some form of modifier, diluent or flavoring. The basic reason for this prior art container is to provide the mixing action at the time of consumption since prior mixing would have adverse effects. The basic ingredient is often not suitable for consumption by itself and requires mixing with a diluent/modifier prior to consumption.

Prior art intra-container mixing prior to use was disclosed in U.S. Pat. No. 5,370,222 to Steigerwald comprising an open threaded container containing a liquid, a powder containing releasable receptacle sealed with foil which is cut by a cutting mandrel during screwing of the receptacle onto the container. Unlike the present invention, the Steigerwald arrangement situates a powder containing receptacle on top of rather than within the container and utilizes a cutting means rather than a two-part sealed plunger means to confine then discharge the receptacle contents.

U.S. Pat. No. 5,863,126 to Guild discloses a baby bottle fluid mixing system comprising a pre-stored powdered substance confined within a first upper container screw disposed atop a second lower container separated by an internal stemmed disk sealed in a snap fit arrangement at the aperture between the bottles, which descends into the lower bottle after removal from the aperture for use. The present invention discloses a capsule body insertable in but not screwed onto a liquid containing bottle and further comprises two sealable plugs or closures rather than one snap fit plug and a disposable, non-reusable interior mounted capsule versus top threaded reusable upper container for pre-stored dry or liquid.

Another such device for separate storage and subsequent mixing of two products was disclosed in U.S. Pat. No. 5,246,142 to DiPalma which comprised a first ingredient container, a second ingredient dispenser compartment plunger arrangement with a weakened wall region inserted within and separated from the container, a removable container closure connected to the plunger and a plunger projection for engagement which ruptures the weakened wall region to release the second ingredient into the first ingredient container. Unlike the present invention, DiPalma's singular sealing means is the reservoir for the second ingredient and fails to create upon activation an orifice for immediate dispensing of the mixed products.

U.S. Pat. No. 5,692,644 to Gueret discloses a container separately storing, then mixing and dispensing two products in which a first liquid containing bottle is separated by a movable wall from a second reservoir containing powder. Force applied to a cylindrical piston in the direction toward the dispensing orifice of the container cuts the seal between the two reservoirs, thereby facilitating the combination and mixing of the two products within the first reservoir of the container. The Gueret apparatus differs from all embodiments of the present invention in that the piston is an integral portion of the slideable base which is snapably attached to the bottle and when compressed with external manual pressure breaks the seals, pushing the contents up into the bottom portion of the liquid-containing bottle thereby accomplishing the mixing of the two products and simultaneously reducing the exterior dimensions of the bottle. The present invention dispenses the dry product without a piston or slideable base integrated within the bottle nor does the overall size of the bottle change during use.

Another separate storage and dispensing device was disclosed in U.S. Pat. No. 4,638,927 to Morane which comprised bottle for liquid having at its neck a leak proof envelope separately storing and enclosing additional product, with a slidable push button perforator in the cap on the bottle neck which opens the envelope to discharge the envelope contents into the liquid in the bottle, thereafter being dispensed through a duct in the cap rather than passing through the perforated center cap area as is the case with the present invention. Morane is also not a two plug system as is the present invention.

The present invention provides a liquid and/or dry ingredients containing capsule that is inserted within the neck or throat of a liquid container, such as a bottle of water, and includes a dispenser. The capsule materials are completely sealed within the capsule body, and remain separated from the liquid in the bottle until the exact moment of usage, which is determined by the consumer by manually dispensing the capsule material (powder or liquid). The capsule can also be conveniently mounted in the throat of the bottle or within/under a standard prior art pull-up liquid dispenser cap without interfering with the sealing of the bottle itself in its normal capping operation. Thus, active ingredients, e.g. activated oxygen, vitamins, herbs, nutrients, or other substances having a short activity life when added to a is particular liquid can now be safely and sealably stored in a capsule until time for use and can be subsequently added to the desired liquid, thereby ensuring that the shelf life and time of activity of the materials are not jeopardized even though they are housed within the liquid container.

The present invention also offers the advantage that it does not require significant modification of bottle caps or existing bottles. In fact, it can be inserted into existing bottles without interfering with the sealability of the conventional bottle and bottle cap.

None of the above prior art taken either alone or in combination, describes, suggests or renders obvious the instant invention as claimed.

SUMMARY OF THE INVENTION

A dispensing capsule for containing a liquid and/or powder materials having substantially a cylindrical liquid impervious body, sized in diameter to fit within the inside diameter of a bottle neck, said capsule having a top circular opening and a bottom circular opening.

The device includes a first disk-shaped plug, sized to sealably fit in said top opening of said capsule body and a second circular disk-shaped plug sized to fit sealably in the bottom opening of said capsule.

The first and second sealable plugs are connected together axially by an elongated shaft that is rigid and has an end portion extending beyond the first and second plugs.

The purpose of the elongated shaft and its extended end portion is to allow the consumer to depress the end of the elongated shaft which, with sufficient force, will cause the plugs which are sealed to the top and bottom openings of the capsule body to be forced away or displaced from the openings of the top and bottom. This will allow any liquid and/or dry contents within the capsule body to be immediately dispensed into the liquid bottle.

In one embodiment, the diameter of the upper disk shaped plug is different from the diameter of the bottom shaped plug. The bottom plug typically will have a larger diameter to allow more liquid or dry contents to be dispensed from the capsule immediately into the bottle and also allows the upper plug to fall through the lower opening into the container. However, the lower plug is larger in diameter than the upper plug so that the entire upper and lower plug and shaft cannot be consumed or retrieved from the bottle, even though the contents of the bottle are empty because the plug will not fit through the upper opening in the capsule body.

In an alternate embodiment, the upper plug diameter could be larger than the lower plug diameter which would prevent the entire plug mechanism from being received into the bottle itself and would allow the plug to be removed by the consumer once the seals are broken and the contents of the capsule emptied into the bottle prior to actually drinking the liquid in the bottle.

In another embodiment, the upper disk shaped plug could be the same diameter as the lower disk shape plug.

Although the plugs have been described as disk-shaped and circular, a variety of different shaped plugs could be used to accomplish the objective of the invention.

To operate the invention, the capsule containing a desired liquid and/or dry ingredients to be dispensed into a liquid in a bottle is inserted into the neck of a bottle containing liquid, typically at the factory, and a conventional bottle cap is added to the bottle. The entire contents of the bottle are then sealed. At the factory, the capsule has been filled with the desired liquid and/or dry ingredients. The plugs are sealed watertight so that the ingredients inside the capsule is contained and cannot drip or fall into the liquid in the bottle once the capsule is inserted in place and so the liquid in the bottle cannot seep into the capsule. At the time the consumer desires to drink the liquid in the bottle, the consumer would remove the bottle cap in the conventional way, and depress the elongated shaft, tearing the first and second plugs away from their seals, creating an opening which allows the contents of the capsule to be dispensed immediately into the liquid in the bottle. As can be seen, the chemical activity life is not effected whatsoever since the consumer is ready to drink the materials in the bottle once mixed. The consumer is then able to pour the mixture from the bottle into a receptacle or may drink directly from the bottle while the plug mechanism stays within the bottle itself or is removed manually by the consumer.

Another embodiment discloses a capsule body which further includes at least a third plug situated and spaced horizontally between said first and second plugs, and further including a means connected to said third plug for disengaging the seal of said third plug and further including said third plug in a first mode sealed to said capsule body. The diameters of all said plugs are preferably equal in diameter, however, the diameters could vary based on the overall shape of said capsule.

Yet another embodiment discloses a capsule, impervious to liquid, for insertion within a prior art pull-up liquid dispenser cap, that contains liquid and/or dry material to be subsequently dispensed into a bottle. The pull-up dispenser cap contains a top opening with a nipple utilized for drinking and a bottom opening larger than the top opening and having a displaceable bottom sealing closure engaging said bottom opening in first position during storage phase which prevents any liquid or dry material from escaping from the capsule body. An elongated plunger located within said cap extends vertically downward and engages and displaces the bottom closure of said capsule body into a second position during utility phase allowing the contents within said capsule body to be dispensed into the bottle when desired.

Another embodiment discloses a capsule, for insertion into a bottleneck, that contains liquid and/or dry materials to be subsequently dispensed into a bottle which includes a first, second, and third plugs. The first plug fits inside said capsule top opening, said second plug fits inside said capsule bottom opening, said third plug is positioned between the first and second plugs and extends in a planar direction within and horizontally bifurcating said capsule body. The first, second and third plugs in a first mode are sealed to said capsule body preventing any liquid or dry materials from escaping from the capsule body. There is a means connected to said first plug and said second plug for disengaging the seal of said first plug and said second plug which allows the material therein to be dispensed from said capsule body into a bottle when desired. The means for such disengagement may be such as to pierce the second plug. The second closure can also be fitted onto or within said capsule bottom opening. The first closure may be circular and disk shaped and of smaller diameter and of greater thickness than the said second closure which may be membranous or circular and disc shaped. The first closure can snapably fit inside of and seal the top opening of the capsule.

In the preferred embodiment of the invention, the capsule containing a liquid or powder includes a hollow, rigid, preferably plastic cylinder, sized in diameter to fit within the neck of a conventional hand-held liquid container or bottle and including an upper annular lip that projects radially from its central axis. The purpose of the extended peripheral lip is to support the capsule across the top of the bottle neck opening so that the capsule does not fall into the bottle. A secondary purpose of the lip is that the lip includes a plurality of apertures which will allow the liquid in the bottle to be poured out of the neck of the bottle when the capsule has been activated.

The capsule also includes a second element in the form of a plunger that includes a cylinder closed at one end by an end face. Disposed within the plunger cylinder are two separated plunging elements that are semi-circular in cross section and tapered from two central plunger stems. The taper is a smooth contour on both plunger element sides so that on each plunger element there is a central rigid, elongated stem that forms the central rib of the actual plunging element itself. The plunger element walls taper from the stem on each side outwardly and curvedly.

The capsule includes at its base portion a sealed liquid-proof membrane, such as aluminum foil, plastic, or any other type of sealing membrane, that can be unsealed and opened by the activity of the plunger elements. The sealing member is adhesively connected to the base perimeter of the cylindrical housing. The liquid or powder to be dispensed is disposed within the capsule cylindrical housing and within the plunging element. The body of the plunger element has an outside diameter that allows the plunger element to fit snugly inside the container capsule cylindrical housing so that the plunger element can be moved manually relative to the outside housing by depressing the plunger element with the operator's thumb. The capsule base is covered with the sealing member so that whatever material, dry or liquid, contained therein cannot escape until the plunger is depressed, separating the sealing member from the capsule base perimeter, except at two critical points. The capsule also includes a top sealing member, such as aluminum foil, plastic, or the like, that is adhesively attached as a thin, liquid-proof member around the capsule top also so that material cannot escape.

The capsule is inserted in the neck of a bottle. At the time one desires to dispense the powder or liquid contained in the capsule, the cap of the bottle is removed and the top sealing member is physically removed by hand from around the lip of the upper capsule body. Once the upper sealing member has been removed, the user will then depress the plunging element downwardly, which causes the plunging element on both sides to engage the bottom seal and to slowly (against the periphery of each plunging element) separate most of the bottom sealing element from the capsule body along the base, allowing the capsule material to be dispensed into the bottle by gravity. Note that the sealing element continues to be attached to the base of the capsule at two points so that the sealing member does not fall into the liquid. Thus, the sealing element is actually opened in two halves along each side of the capsule base, but remains connected to the capsule base at two points at 180 degrees across from each other.

It is an object of this invention to provide an insertable capsule that includes active ingredients that can be readily dispensed into a liquid container at a desired time, thus not interfering with the shelf life or physical/chemical integrity of the ingredients to be combined.

It is an object of this invention to provide a liquid and/or dry ingredient bearing receptacle that includes a dispenser to allow consumers to dispense the liquid or powder into the liquid bearing bottle at any time, the capsule being housed within the liquid containing bottle in a sealed condition.

Still another object of this invention is to provide for sanitary release of the desired ingredients from the capsule into a liquid-containing bottle at a time selected by the consumer, without pre-mixing.

In accordance with these and other objects which will become apparent hereinafter, the instant invention will now be described with particular reference to the accompanying drawings.

BRIEF DESCRIPTION OF THE DRAWING

FIG. 13 shows an exploded side elevation cross sectional view of a snapable means for sealing the plug within the opening in the capsule body as circled "A" in. FIG. 12.

DETAILED DESCRIPTION OF THE INVENTION

Figure 1:
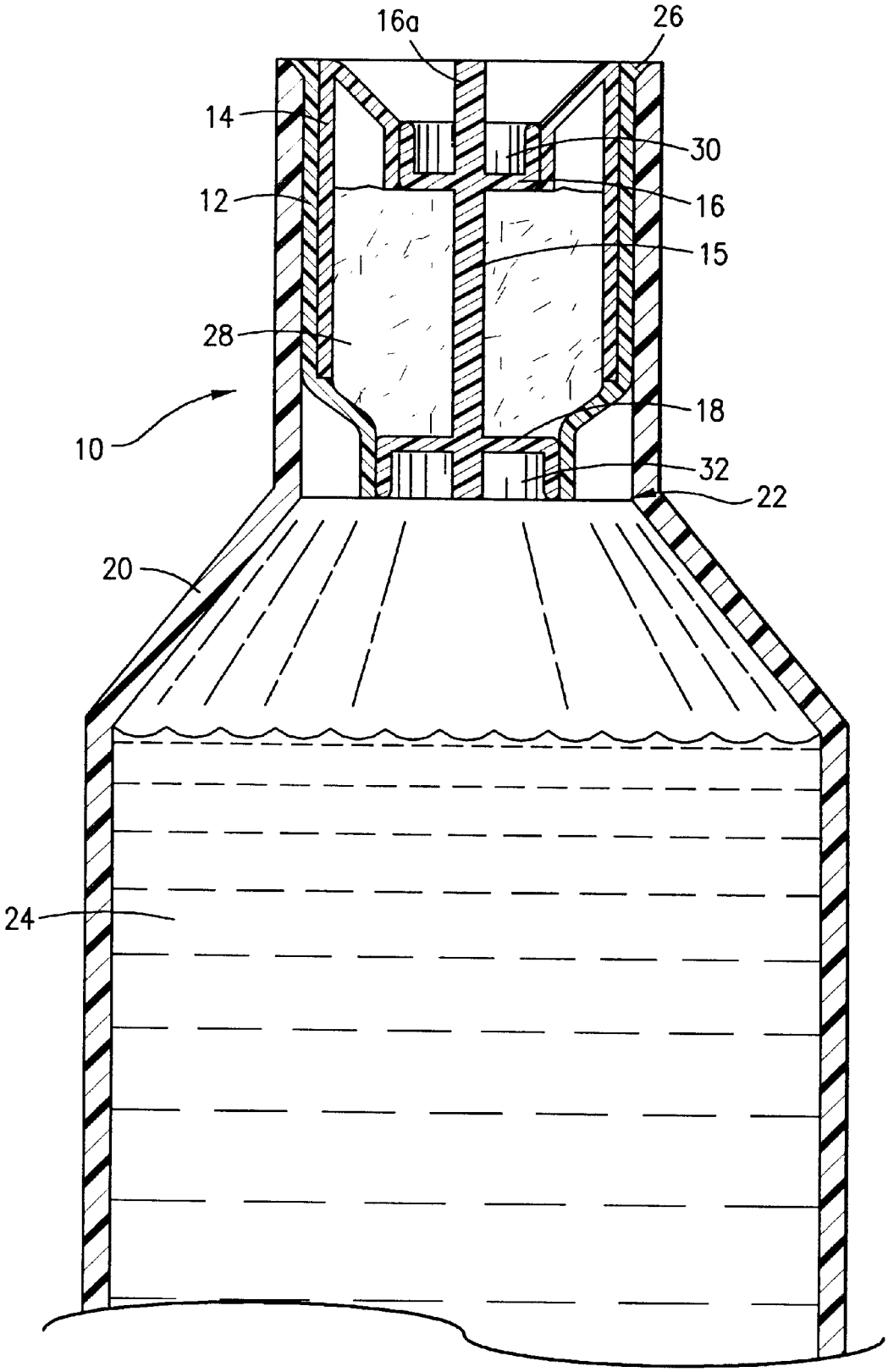
FIG. 1 shows a side elevational cross-sectional view of one embodiment of the invention disposed within the neck of a conventional bottle as would be in use.

Referring now to the drawings and in particular FIG. 1, the present invention is shown generally at 10 comprised of a first capsule body 12 that constitutes the outer body portion of the present invention which is preferably made of a liquid impervious material, preferably polyvinyl plastic. The outer capsule body 12 is cylindrically shaped and includes a tapered smaller cylindrical bottom opening and a top opening. The outer body 12 has an outside diameter that is typically sized to fit snuggly within the neck of a conventional plastic liquid containing bottle, as an example.

Figure 4:
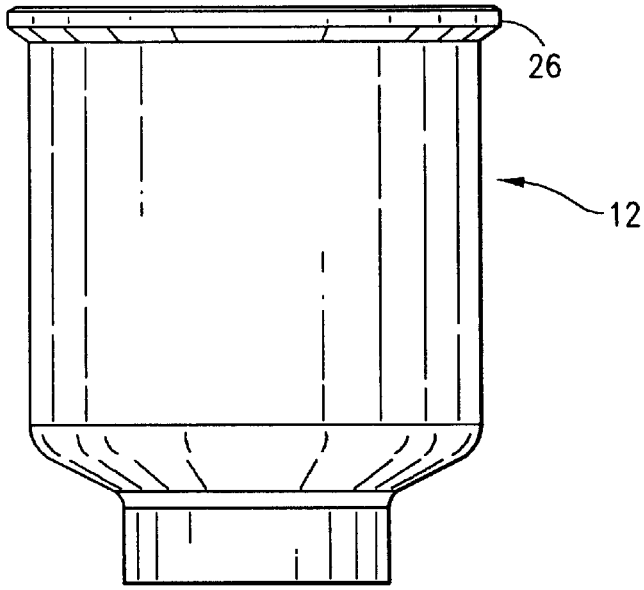
FIG. 4 shows a side elevational view of the outer capsule body of the present invention.

The upper diameter of the opening of the outer capsule body may include a flange chambered wall portion 26 as shown in FIG. 4. The flange prevents the capsule from sliding into the inside of the bottle itself, and is slightly larger than the opening of the bottle. In some embodiments this could be in conjunction with a tapered or chambered portion of the bottleneck at the top opening that is pre-cut to receive a capsule lip around the upper portion of the outer body.

Figure 5:
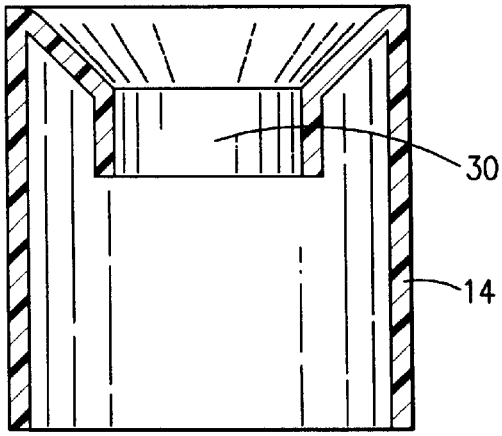
FIG. 5 shows a side elevational cross-sectional view of the inner capsule body of the present invention without the first plug.

The inner capsule body 14 is cylindrically shaped and has a large bottom opening and a much smaller top opening that is also circular and tapered conical wall portion at its top edge terminating in a cylindrical opening as shown in FIG. 5. The first body 12 is sealably attached to the second body 14 with the first body 12 having a groove portion that receives the open base of the second body 14 which can be sealed. The outside diameter of the second body fits snuggly and sealably against the inside diameter of the first capsule body 12. This sealable fit can be accomplished by constructing the capsule bodies 12 and 14 of a softer, moldable material of rubber or synthetic rubber or by using a strong, space-filling water repellant, plastic adhesive.

Figure 9:
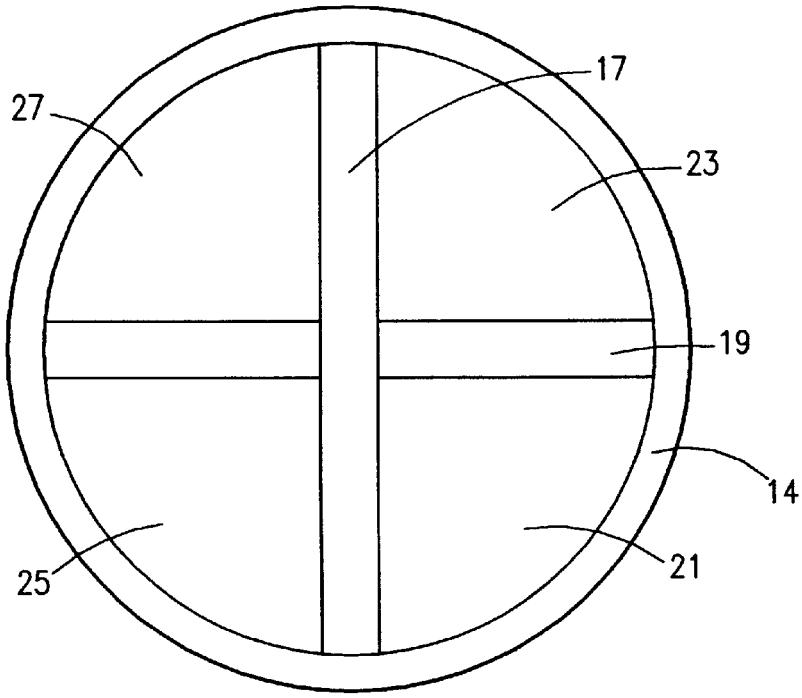
FIG. 9 is an alternate embodiment of the present invention showing four compartments within the capsule.
Figure 10:
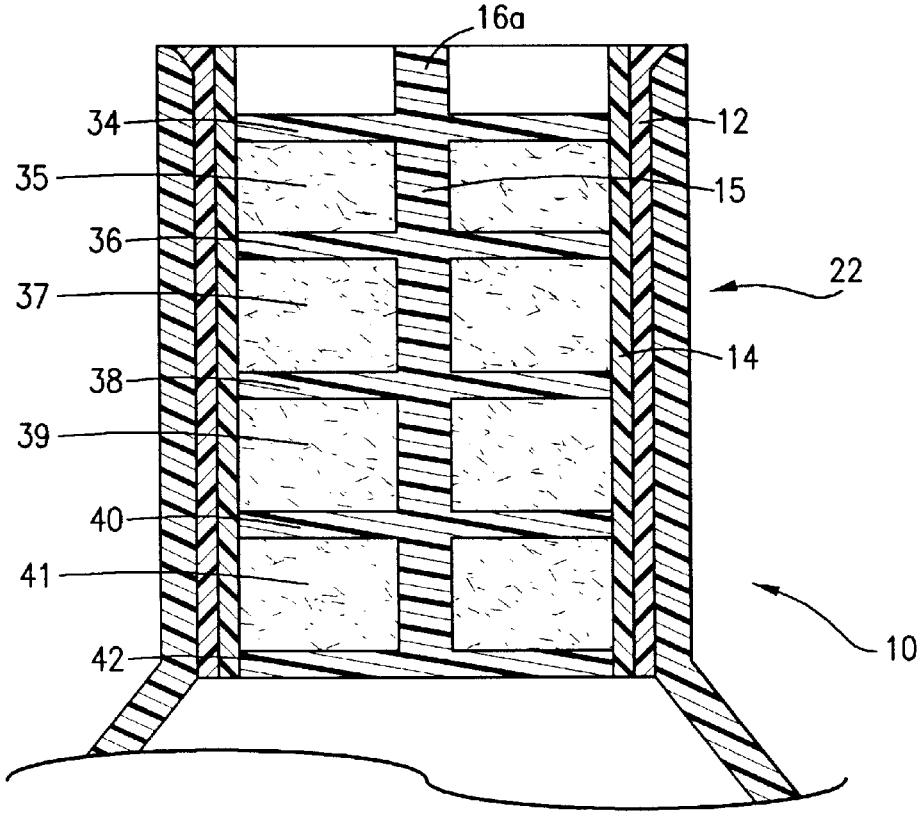
FIG. 10 is a side elevational cross-sectional view disclosing vertically partitioned sections of an alternate embodiment of the present invention.

The capsule may also consist of more than one section created by partitions 17 and 19 joined by shaft 15, first plug 16 and second plug 18, either vertically oriented or horizontally and stackably configured within the capsule so as to accommodate more than one ingredient to be added to the bottle just prior to consumption. FIGS. 9 and 10 reflect these partitioned alternate embodiments. These alternate embodiments can feasibly include 2 to 5 partitioned sections, maybe more, depending on the size of the capsule and bottle on which it is to be used. FIG. 9 discloses shaft 15 widened to the diameter of the capsule to create the longitudal partition to accommodate two ingredients. Although two, three, or four sections can easily be created, FIG. 9 depicts the shaft divided into two full capsule diameter longitudinal partitions at right angles to each other so as to create four quadrants in which liquid or dry ingredients can be factory filled and stored prior to mixing. Three quadrants can also be created in a similar manner by extending shaft 15 in a Y-shaped planar fashion to full diameter of said capsule.

Figure 13:
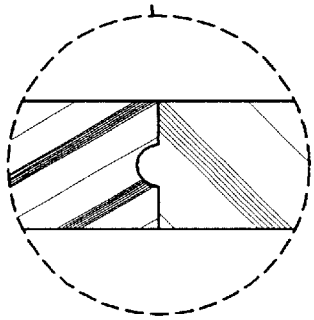

A first disk-shaped plug 16 is sealably mounted within the top opening 30 inside the inner capsule body 14. The seal can be of a pressure-type, snapable interlocking ring as shown in FIG. 13 or other means by which the plug attains airtight disposition against the capsule wall. The first plug includes a cylindrical walled body that is sized in height to correspond to the height of the opening in the upper end of inside capsule body 14. The upper plug 16 has an axial elongated shaft 15 disposed and actually unitarily connected there with an extended portion 16*a* sized from the plug body approximately at or below the level of the bottle top opening itself extended with 16*a* shown of such a length. The entire shaft 15 terminates at its bottom and a second larger diameter disk shaped plug 18 that has its outside diameter sized to sealably fit within the bottom opening 32 of the outside capsule body 12 in the same manner as for the top opening plug. Again the height of the disk 18 is sized to correspond to the length of the opening walls cylindrically for a sealable fit with the outside capsule body 12. As shown in FIG. 1, liquid and/or dry ingredients 28 would be sealably housed within the capsule inside body 14 and within the first and second plugs 16 and 18 in a sealable condition. The bottle itself 20 and bottleneck 22 cannot receive any of the ingredients housed in the capsule itself, because they are sealed.

Figure 2:
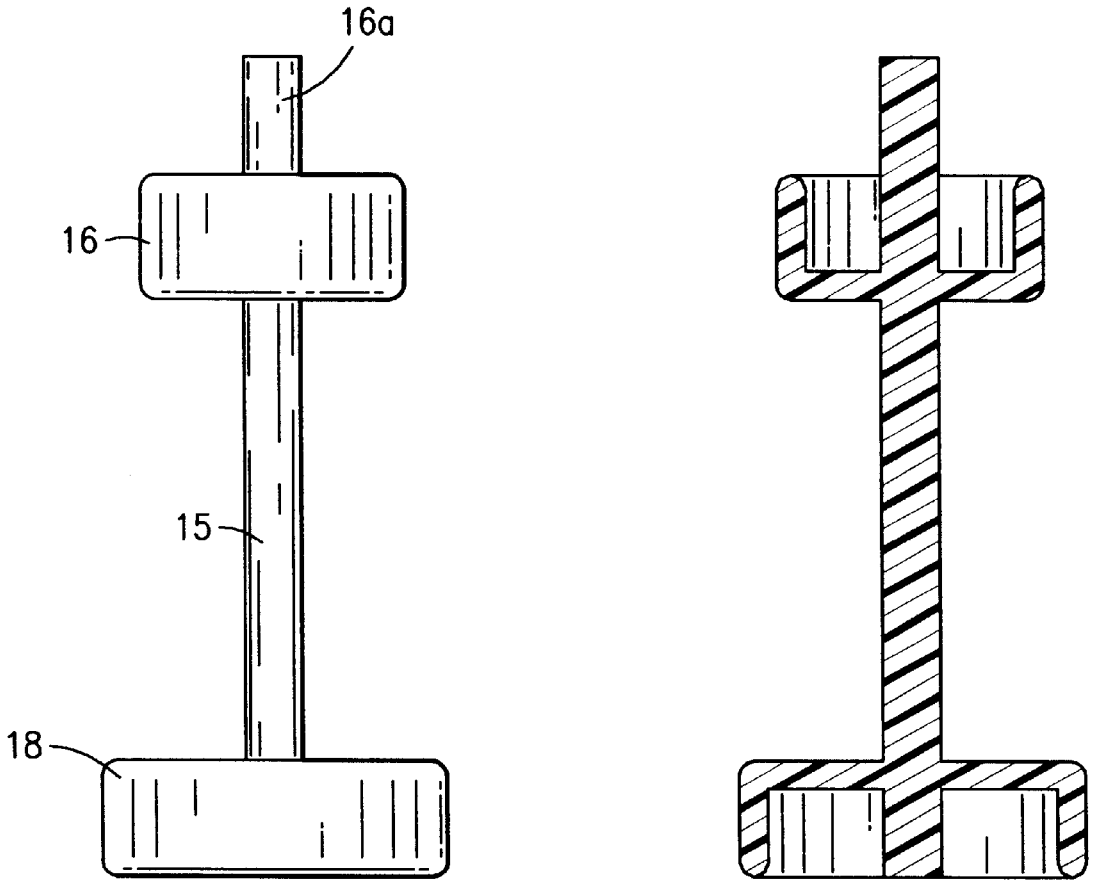
FIG. 2 shows a side elevational view of the first and second disk shaped plugs and the elongated shaft used to seal the capsule body in one embodiment of the present invention.
Figure 3:
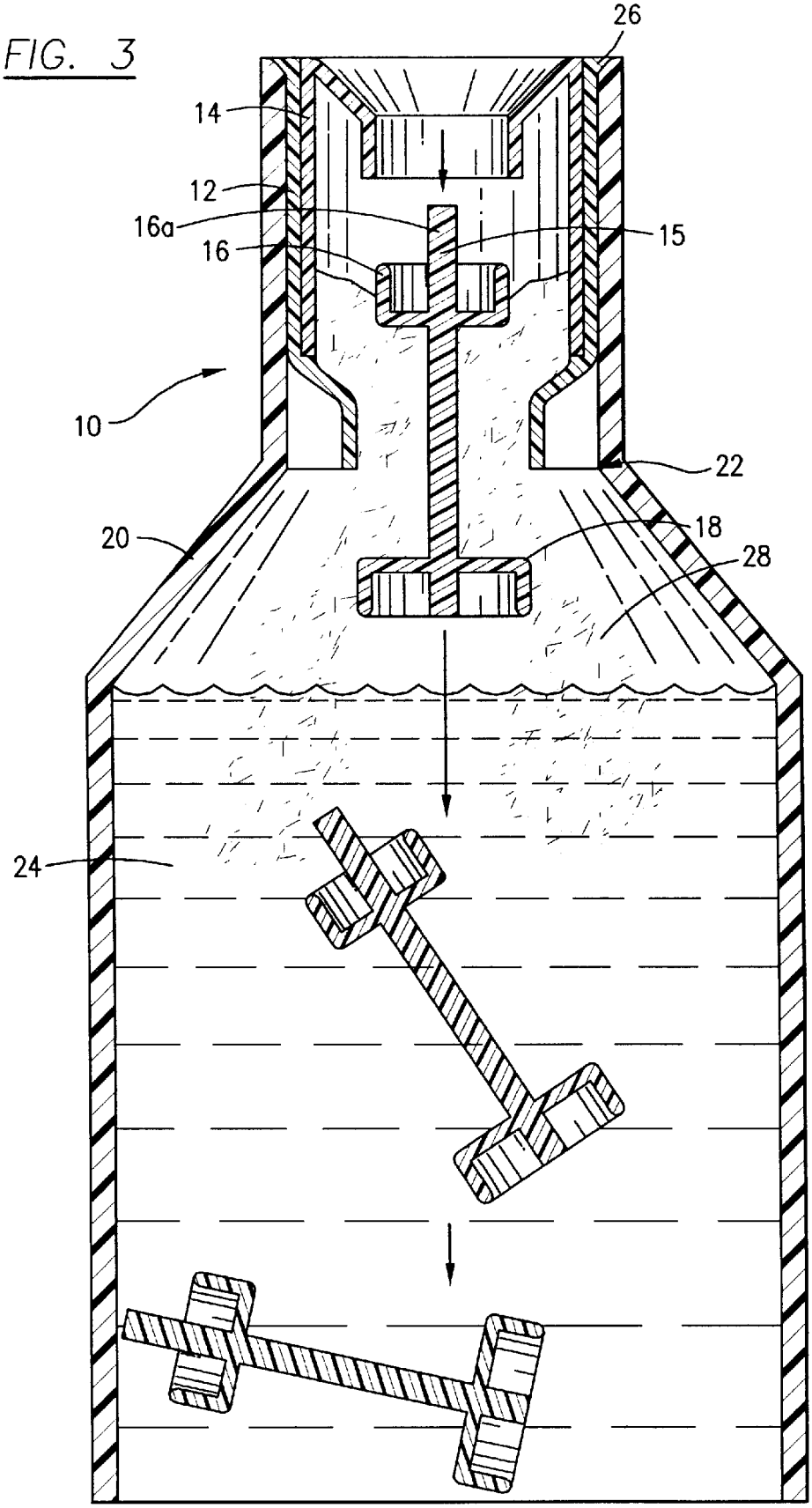
FIG. 3 shows a side elevation, cross sectional view of one embodiment of the capsule, shaft, bottle and plugs at the time of dispensing ingredients from capsule into liquid-containing bottle, including the sequential movement of the plugs and shaft.

The bottle 20 accommodates a liquid component 24. A mixing of the dry or liquid contents 28 of capsule 12 with the liquid 24 is performed in bottle 20 so as to produce a ready to use solution, mixture, suspension or emulsion. To dispense the mixed contents 28 of capsule 12 the consumer would depress the elongated shaft 15 as shown in FIGS. 2 and 3 using extended portion 16*a*, downwardly ripping away the seal formed by the first plug 16 and the second plug 18 causing the entire shaft and first and second plugs to fall within the container itself while at the same time dispensing the capsule contents 28 therein. The plugs and shaft unit within the container would aid in the physical mixing of the capsule ingredients 28 with the liquid 24 within the bottle 20 as shown in FIG. 3. Note, when the diameter of the second plug 18 is larger than the diameter of the top opening of the inside capsule wall 14, the shaft plug mechanism is prevented from being removed from the bottle itself during consumption and thereby prevents the consumer from accidentally receiving the first and second plug. The plug/shaft mechanism can be made of a floatable or lightweight material to avoid blocking the outflow of the fluid when the bottle is tipped in the drinking or pouring process. The capsule can be made of dark, opaque material to provide limited light (U.V. rays) access of the capsule contents to guard against deterioration from light.

Figure 7:
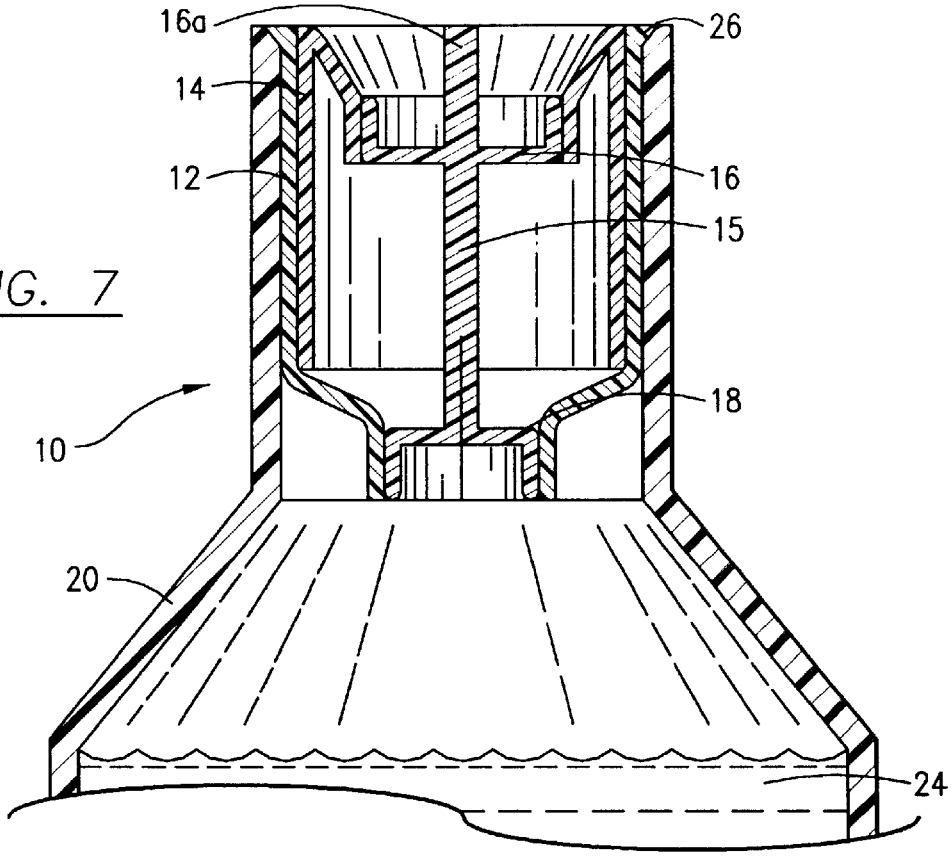
FIG. 7 is a side elevational cross sectional view of an alternate embodiment of the present invention.

In an alternate embodiment, shown in FIG. 7, the plug diameters could be reversed in that the lower plug 18 is of smaller diameter and the upper plug 16 is of larger diameter which would prevent the entire plug mechanism from being dispensed within the bottle and allowing it to be physically removed if desired by the consumer after the ingredients in the capsule have been dispensed and mixed. The physical presence of the entire plug mechanism within the liquid aids mixing on agitation.

Figure 8:
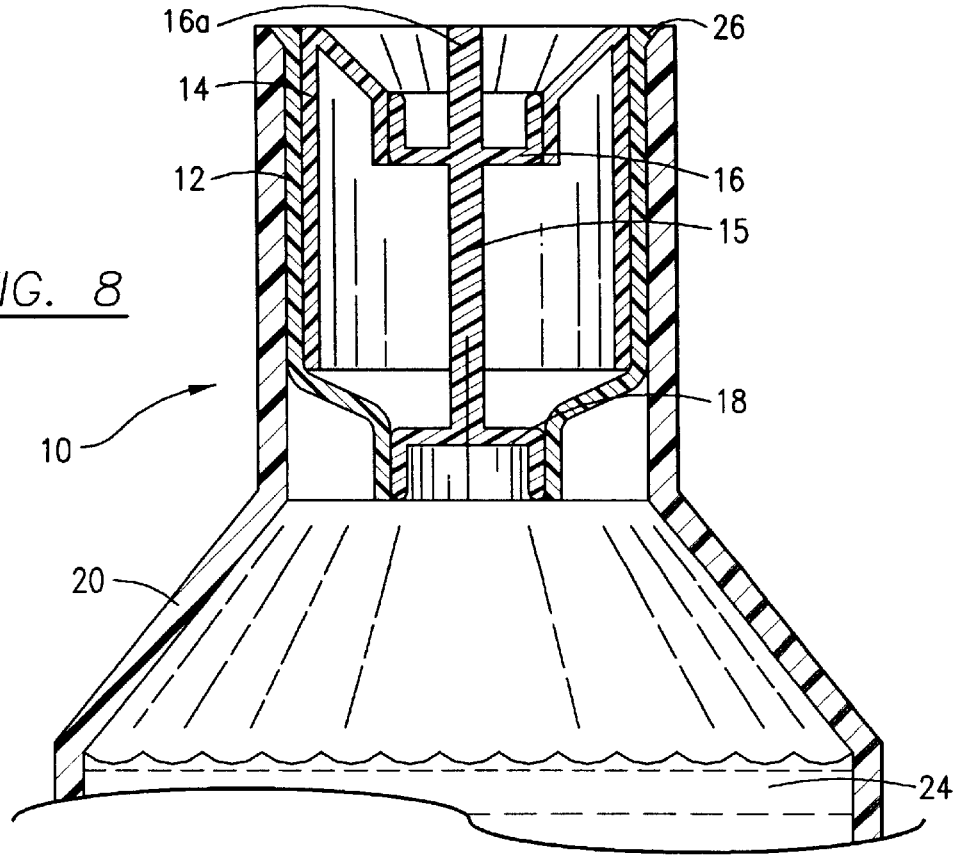
FIG. 8 is a side elevational cross sectional view of an alternate embodiment of the present invention.

Another embodiment would provide equal diameters of the lower plug 18 and the upper plug 16 as shown in FIG. 8.

Figure 6:
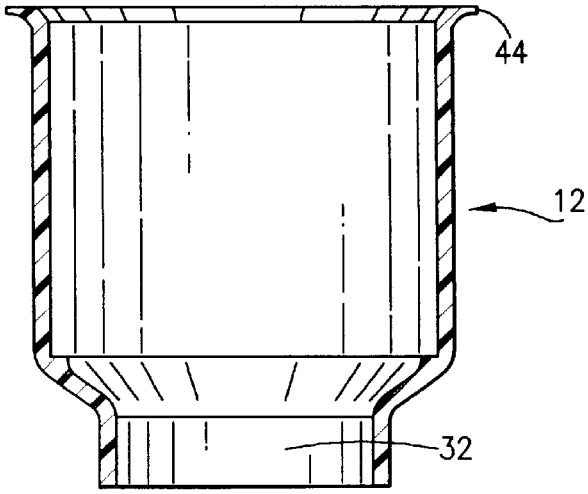
FIG. 6 shows a side elevational cross sectional view of the outside portion of the outer capsule body of the present invention.

The upper opening of the outer capsule body 12 includes a lip 44 that engages the top edge of the bottle so that when a cap is screwed on the bottle it would seal and prevent the entire capsule from falling into the bottle without requiring modification of the bottleneck as shown in FIG. 6.

In operation, the entire capsule 10 or each partitioned section created within capsule 12 would be filled with the desired dry or liquid ingredients to be dispensed and plugs 16 and 18 sealed at the factory. The capsule is then inserted into the neck 22 of bottle 20 containing a liquid 24 and a sealable cap is added to the bottle. The size and shape of the capsule can be modified to accommodate varying amounts of ingredients to be added to the bottle. The bottle with its liquid contents 24 and the capsule could sit for extended periods without ever being activated. When the consumer wishes to drink the contents of the bottle, he would remove the cap of the bottle and depress the elongated shaft using the extended portion 16*a*, ripping away the seals of plug 16 and 18, and emptying the capsule contents 28 into the bottle. The user can then drink the materials which have been mixed in the bottle. The entire bottle and capsule can be recycled or discarded as desired.

Another embodiment, FIG. 10, discloses for example, five representative (first through fifth) horizontal planar plugs 34, 36, 38, 40 and 42 creating at least 5 fillable sections of capsule, the diameter of all plugs being equivalent and sized so as to negate the tapering of the outside capsule body and extending the full diameter of the bottleneck 22. The plugs are unsealed when extended portion 16*a* is depressed manually which releases the contents of all sections of the capsule 12 along with the plugs and shaft into the bottle. The size of capsule and bottle, thickness of plugs, and the number, type and quantity of contents selected will determine the number of horizontal plugs in the desired embodiment. Shaft 15 may be extended in a vertical planar fashion creating partitions 17 and/or 19 as shown in FIG. 9 and extending to the full diameter of the capsule longitudinally bifurcating said capsule into two fillable sections both with the presence of the horizontal plugs as shown in side cross section view in FIG. 10 or without said horizontal plugs as shown in top cross sectional view of FIG. 9, thereby creating only 4 fillable sections 21, 23, 25, and 27 extending the full longitudinal length of said capsule from said first plug 16 to said second plug 18.

Figure 11:
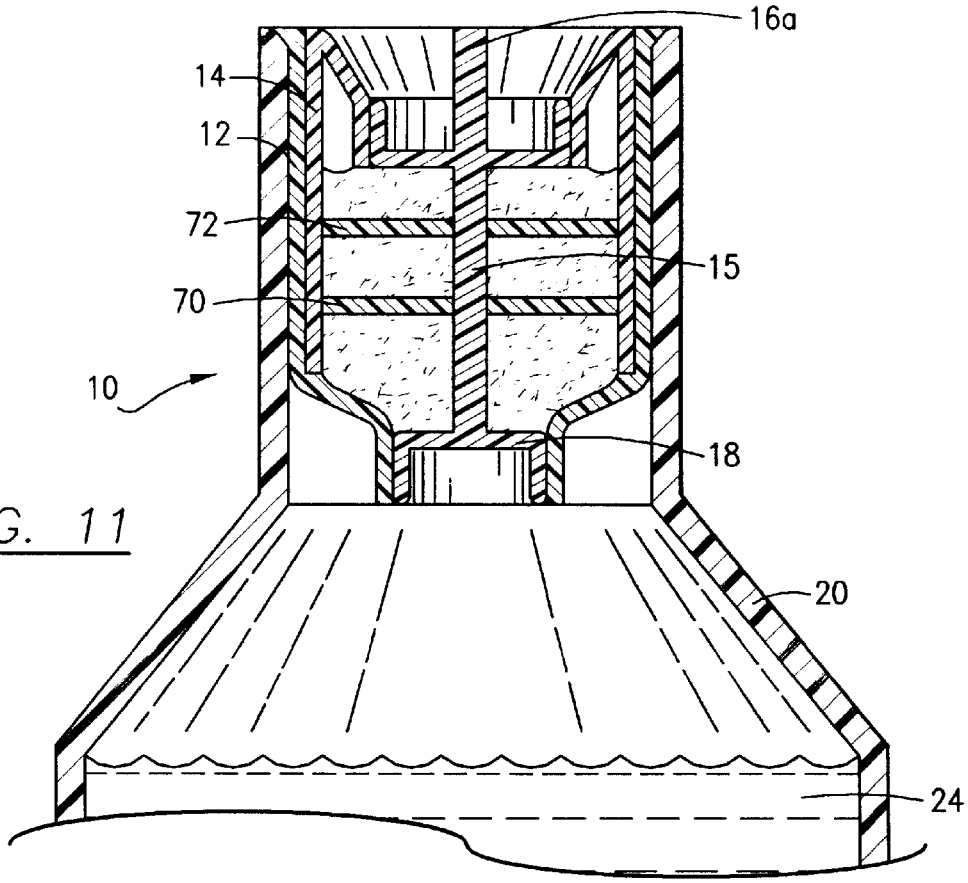
FIG. 11 is a side elevation perspective view showing horizontally partitioned sections of the capsule body of the embodiment of FIG. 1.

FIG. 11, is an alternate embodiment similar to the first embodiment described in FIG. 1 wherein shaft 15 is cylindrical and elongated but not extended in a vertical planar fashion to the full diameter of the capsule. FIG. 11 additionally discloses two (but could contain one or more) unitarily molded horizontal planar extension plugs 70 and 72, located between said first plug 16 and said second plug 18 and of sufficient thickness to provide water-tight compartments between said plugs 70 and 72. This embodiment would provide three factory fillable compartments when two plugs 70 and 72, are situated, four factory fillable compartments when three plugs are situated between plugs 16 and 18, and so on. The number of additional plugs between plugs 16 and 18 is as in other embodiments primarily dependent upon the size of the capsule and bottle, plug thickness, and the number of different ingredients to be stored in said capsule 12.

Figure 12:
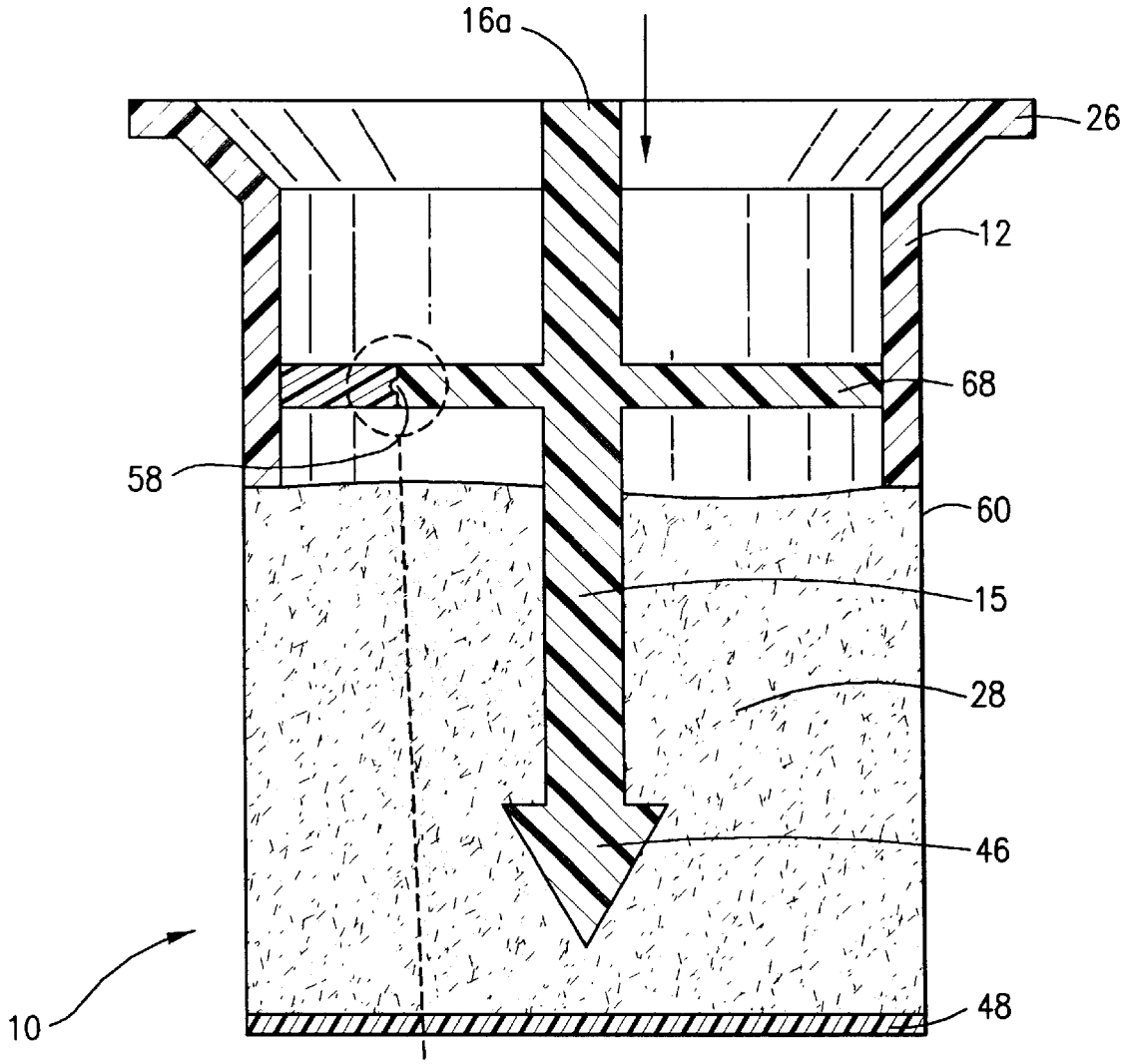
FIG. 12 shows a side elevation cross sectional view of the preferred embodiment.

FIG. 12, the preferred embodiment of the present invention, comprises a capsule body 12 cylindrically shaped and with a top opening sealed by a disk shaped plug 68 in first mode as shown and bottom opening sealed by a membrane 48, preferably heat welded, to the capsule body, however any means sufficient to create a water tight seal with the capsule can be used. There is a first end, extended portion 16*a* of the elongated shaft 15 and a second end 46, shaped and sized so as to cut a sufficiently large opening when pushed into contact with and piercing membrane 48 to allow the entire contents to fall quickly into the container without obstruction or blockage. Manual downward pressure should be applied to the extended portion 16*a* sufficient to place the second end 46 into contact with and cutting the membrane 48 to allow the capsule contents 28 to fall into the liquid 24 within the container. The membrane 48 can be made of foil, coated paper, liquid resistant material, or polyvinyl sheet of easily tearable thickness. Shaft 15 in this embodiment should be of such length as to not pierce the membrane seal 48 during normal storage, or with movement during transportation by manufacturer or consumer, but also of sufficient length as to reach and also pierce the membrane 48 covering the bottom opening of capsule 60 when moderate manual pressure is applied to extended portion 16*a* which thereby disengages seal 58 at plug 68. The disengagement of seal 58 at plug 68 and opening created by the piercing of membrane 48 will enable the subsequently mixed contents 28 of the capsule and liquid 24 in the bottle to flow back through to the consumer in the drinking process. The capsule can also be manually removed by consumer and discarded prior to drinking. An exploded cross sectional side elevation view of the interlocking ring sealing means of plug 68 is shown at FIG. 13. The container 60 below plug 68 is connected to capsule 12 preferably by a heat sealing means, said container 60 being constructed from materials which are water resistant, light weight, durable and inexpensive such as polyvinyls, reinforced or coated papers, or metal and filled at the factory with the desired liquid and/or dry contents 28 to be added to the bottle 20 prior to use.

Figure 14:
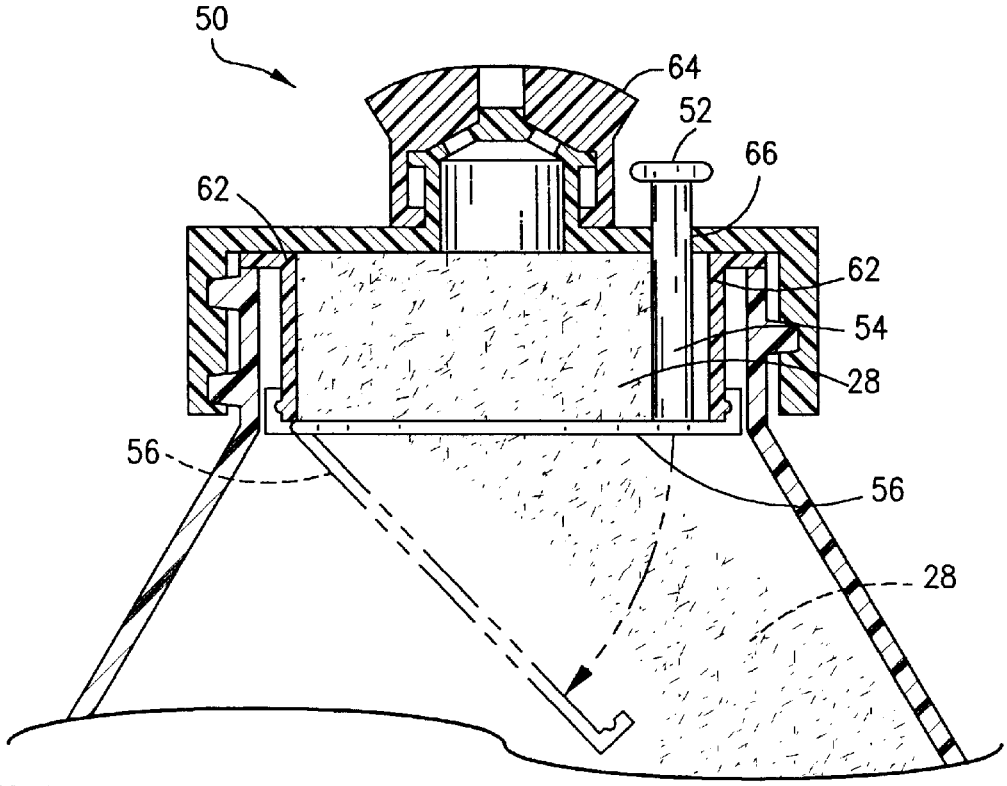
FIG. 14 shows a side elevation cross sectional view of alternate embodiment of the capsule body molded as part of the prior art pull-up liquid dispenser cap with bottom sealing closure disengaged.

FIG. 14 is another alternate embodiment in which a prior art pull-up liquid dispenser cap shown generally at 50 is modified with the improvement comprising receptacle 62 being unitarily molded to or snapably attached under dispenser cap 50 and directly accessible to the nipple 64. Receptacle 62, is liquid impervious and constructed with an opening 66 located in the top portion of said receptacle adjacent nipple 64 of a size to accommodate an elongated plunger 54 with first end 52 extending above said top portion of receptacle 62 and shaft 54 extending vertically downward into direct contact with bottom sealing closure 56 of receptacle 62. Bottom closure 56 can be constructed of durable liquid impervious material, such as polyvinyl or electromeric membrane which will disengage from one side of the receptacle while remaining hingeably or sealably attached at the opposite side of said receptacle thereby preventing closure 56 from descending into the liquid 24 in bottle 20 yet allowing sufficient area to enable the mixed liquid to flow back from bottle 20 to the consumer through second top opening 74 and nipple 64 in said cap 50 without blockage during normal drinking process. Plunger 54 is sized to fit snuggly and sealably to prevent the dry or liquid contents 28 from seeping out of opening 66. Plunger 54 is vertically slideable with moderate manual pressure to first end 52 so as to disengage or unseal the bottom closure 56 of capsule 62 allowing contents 28 to fall into the liquid 24 in the bottle.

Figure 15:
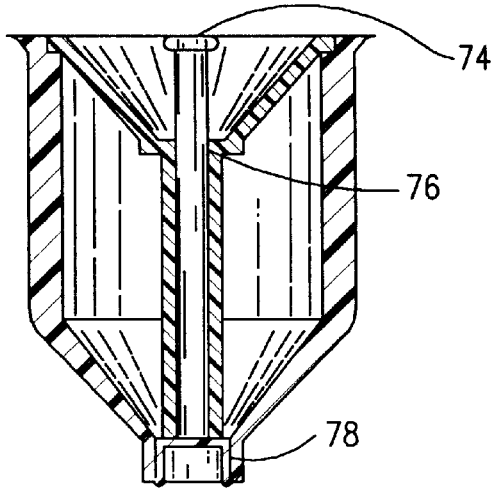
FIG. 15 is a side elevation view in cross-section of an alternate embodiment of the invention.

Referring now to FIG. 15, an alternate embodiment of the invention is shown which is comprised of a two-piece assembly making the construction easier and less costly. The outer body also includes a molded lower disk portion that seals the unit but has a wall portion that allows the plunger to force open the bottom of the container. A portion of the invention includes a conical insert having a diameter sized to only fit along the top opening of the outside housing. The unit includes the plunger 74 and sealed upper 76 or lower portions 78 which can be broken open by pushing down the plunger.

Figure 16:
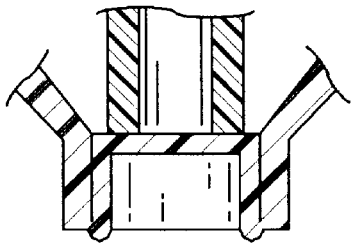
FIG. 16 is a side elevation of view partially cut away of the bottom portion of the alternate embodiment shown in FIG. 15.

FIG. 16 shows how the bottom of the plunger is molded as one-piece with the bottom portion of the housing. The weakened wall portion will allow the bottom part of the plunger to rip away from and leave an opening so that the material can be dispensed as above. The operation of this invention is similar to the preferred embodiment but requires fewer pieces for construction.

Figure 17:
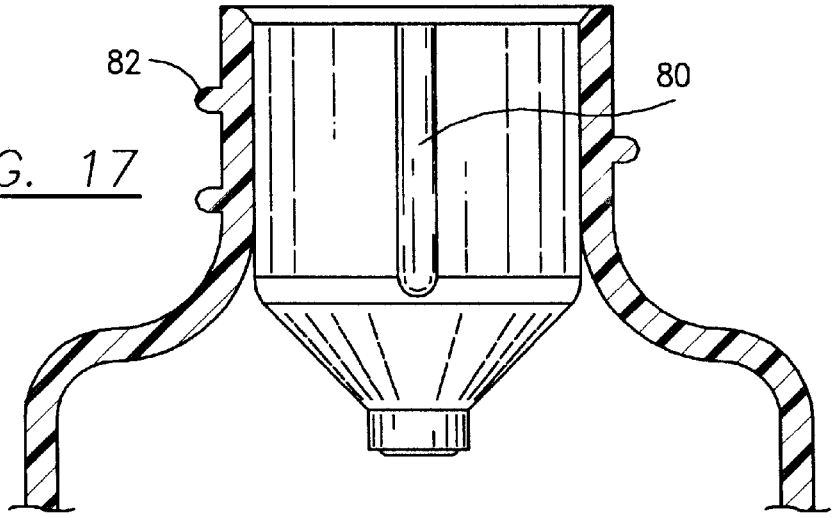
FIG. 17 is a side elevation view partially in cross-section of the alternate embodiment shown in FIG. 15.

FIG. 17 shows the entire housing mounted in the bottle cap of our bottle top opening with side view of cap screw threads 82. The present invention includes slotted side walls 80 providing a space between the invention housing and the inside of the bottle wall. The space allows the fluid or liquid once mixed to be deployed out of the bottle cap neck without removing the capsule.

Figure 18:
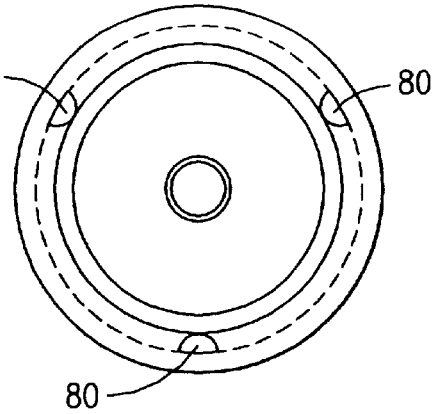
FIG. 18 is a top plan view of the alternate embodiment shown in FIG. 15.

FIG. 18 shows the top plan view of slotted aide walls 80 through which fluid can pass from the bottle to the consumer without removing the capsule.

Referring now to FIGS. 19, 20, 21, and 22, the referred embodiment of the invention is shown. Capsule 100 includes a capsule body 102 which is basically a rigid, cylindrical chamber 104 which may be made of plastic that includes an annular lip 106 that has a larger diameter than the hollow cylinder 104. Lip 106 engages the top of the bottle to keep the entire device from falling into the bottle. However, the outside diameter of the capsule 102 is sized to fit comfortably within the neck of a conventional liquid bottle, or it could be made for different sized bottles by changing the diameter so that the capsule fits snugly in the top of the bottle. A plurality of apertures 108 allow for passage of liquid from within the bottle once the cap has been removed, so that someone can consume the liquid in the bottle which passes through apertures 108 from inside the bottle to outside the bottle with the capsule in place. Alternatively, the capsule could be removed once the materials have been dispensed. The plunger 110 has a top cylindrical portion 112 with an outside diameter that fits snugly within the capsule body 104. The plunger 110 also includes a pair of plunging elements 114 and a side elongated plunging brace or stem member 116 on each side and a space 130 on each side.

The device includes a thin liquid-proof liquid barrier 118 that is sealed around the base 104*a* of the capsule. Adhesive 118*b* deposited on the thin membrane which can be waterproof plastic or aluminum foil includes an adhesive 118*b* that allows it to fit and be sealed to the bottom edge 104*a* of the capsule housing 104. A second sealing member 120 is provided for sealing the entire capsule across the top and fits with an adhesive exactly the size of the lip of the capsule.

Figure 19:
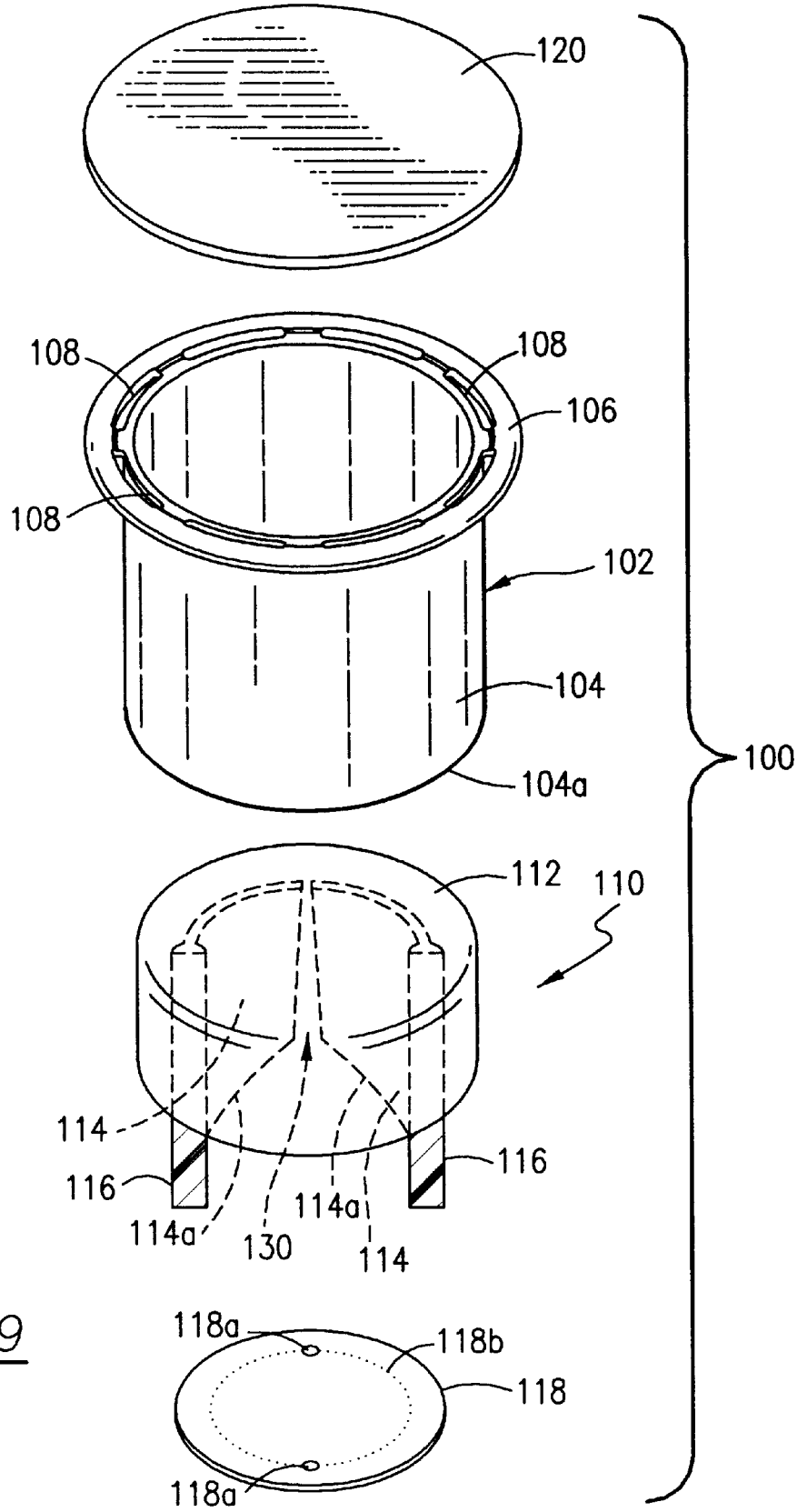
FIG. 19 shows an exploded view of an alternative embodiment of the invention that is the preferred embodiment of the invention.
Figure 20:
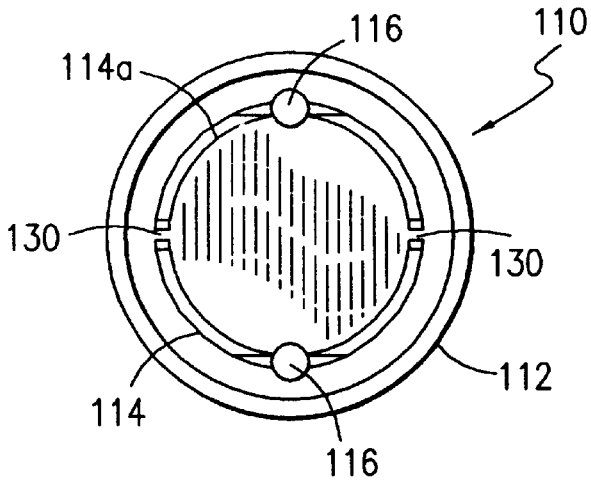
FIG. 20 shows a bottom plan view of the plunging element used in the present invention.
Figure 21:
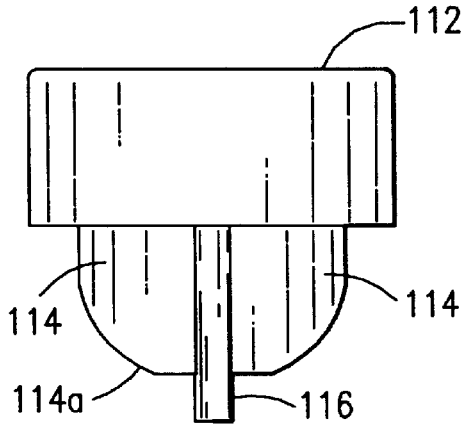
FIG. 21 shows a side elevational view of the plunging element used in the present invention.
Figure 22:
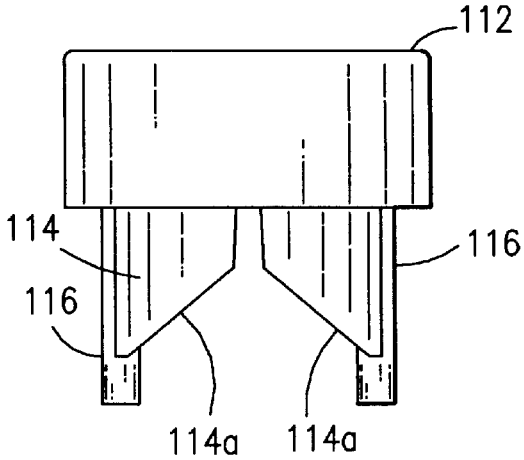
FIG. 22 shows a side elevational view rotated 90 degrees from the view shown in FIG. 21 of the plunging element used in the present invention.

Referring now to FIGS. 20, 21, 22, and 23, the plunger is shown having an upper body portion that is cylindrical 112, the outside diameter of which fits within the capsule body 104 shown in FIG. 19. The plunging elements 114 are curved and are semi-circular or semi-cylindrical in shape and are also tapered along the bottom in an upward direction along surface 114*a*. As the plunging element is depressed, the surface area 114*a* contacts the lower sealing member 118 and pushes against the sealing member, separating it from the base of the capsule along surface 104*a* without tearing it. Thus, almost the entire sealing member 118 is separated from the bottom of capsule 104 along 104*a* surface area, except for two important areas. Areas 118*a* on the sealing member represent areas that remain fixed to the capsule base 104*a* and do not separate, so that the foil or plastic seal 118 does not fall into the liquid in the bottle. Because of the shape of the plunging elements 114 and the taper along the bottom 114*a* and space 130 on each side, the sealing member can be quickly and safely separated by pushing down on plunger 112 until a point is reached when almost the entire sealing member has been separated, allowing the contents, whether it be powder or liquid, to be dispersed into the bottle. At spaces 130, the plunging member does not contact the sealing member, allowing areas 118*a* to remain attached to the capsule base.

Figure 23:
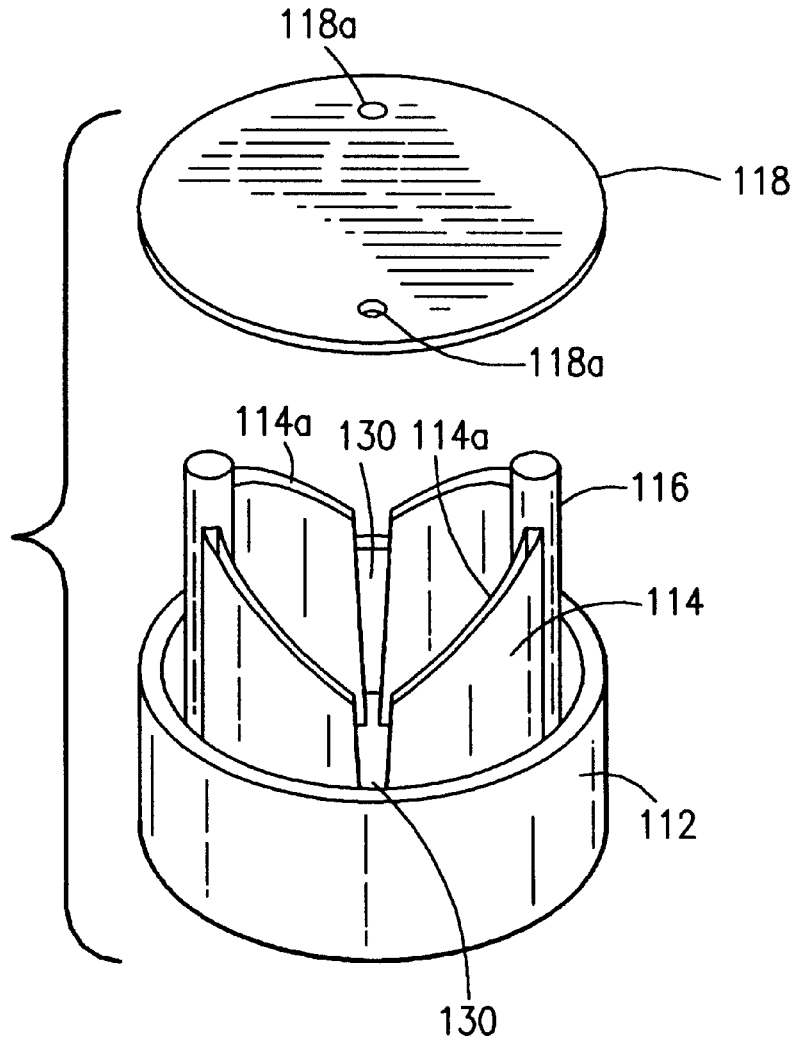
FIG. 23 shows a bottom perspective view of the plunging element and capsule base sealing member.

FIG. 23 shows the plunging element 112 inverted, and the curvature of the plunging elements 114 can be seen along their surfaces that are tapered 114*a*, which contact the sealing member.

Referring back to FIGS. 19 and 23, the space 130 on each side of the device insures that the plunging element 114 does not contact sealing member 118 at all 180 degrees from each other. The sealing member has an area 118*a* on both sides across from each other that remain sealed to the base surface 104*a* of the capsule body 104. This means that the sealing member will not fall into the container. Thus, the areas designated 118*a* on sealing member 118 in FIG. 23 would not contact the plunging element surface 114 at all because of space 130 in the plunger on each side. Therefore, the sealing member is not severed or disconnected from the body of the capsule 104 when the plunger has been depressed so that the plunging element 116 starts the removal process of the seal from the capsule body. Rather than tearing it, the tapered portion then smoothly depresses more on the sealing element, causing it to spread apart from the body.

Figure 24:
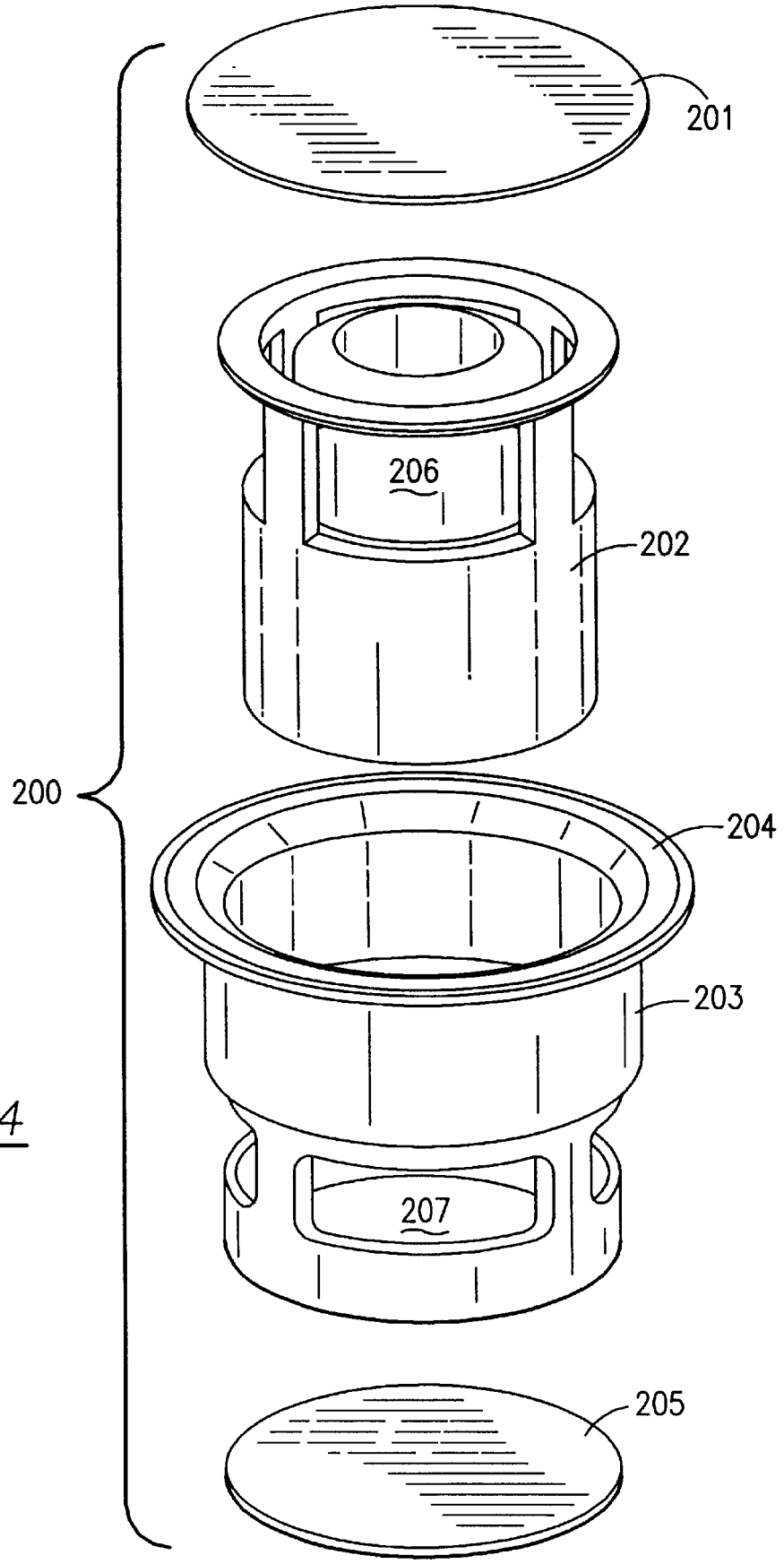
FIG. 24 shows an exploded perspective view of yet another embodiment with vents to permit liquid flow through the capsule.

Referring now to FIG. 24, yet another embodiment of the invention is shown generally at 200 in an exploded view that includes the capsule body 203 having a lip 204 that prevents the capsule body 203, which is sized to fit into the neck of a bottle, from falling into the bottle. Sealing members 201 and 205 are attached to and sealed at the top and bottom of the capsule. The plunger 202 fits within housing 203 and is depressed downwardly to effectively remove seal 205 to dispense liquid or powder that is in housing 203 and plunger 202. Plunger 202 has a plurality of vents 206 disposed around its upper portion which allows liquid to pass therethrough. After the seal 201 is removed and the plunger is activated and seal 205 is removed, it is desirous to drink liquid from the bottle or container. Capsule body 203 includes a plurality of vents 207 disposed around its base. When the plunger 202 has been activated by depressing it downwardly, there will come a time when vent 206 in plunger 202 is aligned with vent 207 in capsule body 203, which will then allow fluid to flow from inside the bottle through vent 207 through vent 206 out the bottle.

The instant invention has been described herein in what is considered the most practical and preferred embodiment. It is recognized, however, that departures may be made therefrom within the scope of the invention and that obvious modifications will occur to a person skilled in the art.

What is claimed is:

1. A capsule, for insertion within a liquid dispenser, where the capsule contains at least one of a liquid and dry material to be subsequently dispensed into the liquid dispenser comprising:

a capsule body that is impervious to liquid where said capsule body has an hollow cylindrical shape;

said capsule body fitting within a opening of said liquid dispenser;

said capsule body having a top opening and a bottom opening;

said capsule body having an annular lip where the annular lip extends around the top opening and the annular lip has a larger diameter than the capsule body and a plurarity of apertures within the annular lip which allow the passage of fluid from the liquid dispenser;

said capsule body having a displaceable bottom sealing closure engaging said bottom opening in first position during a storage phase which prevents the at least one of liquid and dry material from escaping from within the capsule body; and an elongated plunger located within said capsule body extending vertically downward engaging and displacing the bottom closure of said capsule body into a second position allowing the at least one of liquid and dry material within said capsule body to be dispensed into the liquid dispenser when desired.

2. The capsule according to claim 1, where the elongated plunger includes a top cylindrical portion the fits within the capsule body, a pair of plunging elements and at least one elongated pluning brace, where the pair of pluning elements extend vertically downward away from the top cylindrical portion.

3. The capsule according to claim 1, where a adhesive seals the displaceable bottom sealing closure to the bottom opening.

4. The capsule accorind to claim 1, where a top sealing member seals the top opening of the capsule body.

5. The capsule accorind to claim 4, where an adhesive seals the top sealing member to the top opening.

6. The capsule accoriding to claim 2, where the pair of plunging elements are at least one of curved, semi-circular and semi-cylindirical in shape, and are tapered along the bottom in an upward direction.

7. The capsule according to claim 1, where a portion of the bottom sealing closure remains fixed to the capsule body while in the second position.

8. The capsule according to claim 7, where the pair of plunging elements ensure that a portion of the bottom sealing closure remains fixed to the capsule body.

* * * * *